US007887386B2

(12) United States Patent
Yu

(10) Patent No.: US 7,887,386 B2
(45) Date of Patent: Feb. 15, 2011

(54) SENSORY STIMULATION PLUSH

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 1035 days.

(21) Appl. No.: 11/169,193

(22) Filed: Jun. 28, 2005

(65) Prior Publication Data

US 2005/0287912 A1 Dec. 29, 2005

Related U.S. Application Data

(60) Provisional application No. 60/583,771, filed on Jun. 29, 2004.

(51) Int. Cl.
*A63H 3/02* (2006.01)
*A63H 3/00* (2006.01)

(52) U.S. Cl. ..... 446/369; 446/72; 446/385

(58) Field of Classification Search ..... 446/369, 446/370, 385, 372, 71–76
See application file for complete search history.

(56) References Cited

U.S. PATENT DOCUMENTS 833,448 A * 10/1906 Vall et al. ..... 430/496
4,197,670 A * 4/1980 Cox ..... 446/369
4,795,397 A * 1/1989 Stevens ..... 446/320
4,968,279 A * 11/1990 Smith ..... 446/71
5,009,626 A * 4/1991 Katz ..... 446/391
5,749,764 A * 5/1998 Bailey ..... 446/427
5,966,763 A 10/1999 Thomas et al. ..... 5/715
6,805,607 B2 * 10/2004 Hidalgo ..... 446/369
2002/0112287 A1 8/2002 Thomas et al. ..... 5/503.1
2004/0013853 A1 1/2004 Mandzsu et al. ..... 428/143

OTHER PUBLICATIONS

Mogu (2003) from http://www.mogu.com/section/what.jsp.

* cited by examiner

*Primary Examiner*—Kien T Nguyen

(57) ABSTRACT

Sensory stimulation plush affords photographic imagery with an attractive tactile sensation. The plush has a fiber fabric skin having a linear elastic elongation of at least 50% in a first direction in the plane thereof. The skin is formed into a plush shape so as to define a cavity. A particulate fill is provided within the cavity. A photographic image emulative of a person, animal or object is imprinted on the fabric skin so as to maintain the least 50% linear elastic elongation associated with the skin.

17 Claims, 1 Drawing Sheet

SENSORY STIMULATION PLUSH

RELATED APPLICATION

This application claims priority of U.S. Provisional Patent Application Ser. No. 60/583,771 filed Jun. 29, 2004, which is incorporated herein by reference.

FIELD OF THE INVENTION

The present invention in general relates to a plush article, in particular to a plush article having graphics and tactile properties to enhance sensory stimulation.

BACKGROUND OF THE INVENTION

Infants from a young age have an affinity for dolls. This affinity often extends to the formation of a relational bond between a person and a doll that extends beyond childhood and into adulthood. Traditionally, dolls have been formed of rigid materials able to receive emulative doll features or, alternatively, dolls have been made of a stuffed fabric skin, that while not emulative of the facial features of a doll, intends to offer a soft compressible textile sensation. As a result, a child must choose between a doll having visually emulative doll features formed in porcelain, plastic, clay, or other rigid material that has a cold, lifeless feel, or be content with a doll that is visually abstract, yet has a comforting, compressive feel. Prior art attempts to create dolls that are a hybrid have, as to date, been unsatisfactory.

Behavioral science has established touching a tactically pleasing object has a calming effect on an individual. Additionally, it has been shown that visual appearance is an important factor in bonding and recognition. Conventional dolls have forced an individual to choose between visual and tactile sensory satisfaction.

Thus, there is a need for a plush article having a graphic image emulative of a person, animal, or object that retains the attractive tactile sensation of the plush article.

SUMMARY OF THE INVENTION

Sensory stimulation plush affords photographic imagery with an attractive tactile sensation. The plush has a fiber fabric skin having a linear elastic elongation of at least 50% in a first direction in the plane thereof. The skin is formed into a plush shape so as to define a cavity. A particulate fill is provided within the cavity. A photographic image emulative of a person, animal or object is imprinted on the fabric skin so as to maintain the least 50% linear elastic elongation associated with the skin.

A plush is formed by transferring a photographic image emulative of a person, animal or object onto a fabric skin that has a linear elastic elongation of at least 50% in a first direction. The image transfer is accomplished by dye sublimation and therefore maintaining the linear elastic elongation of at least 50% in a first direction within the plane of the fabric skin. The fabric skin is formed to define a cavity that in turn is filled with particulate. The particulate fill is sealed within the cavity. Optionally, a containment bag is provided that contains the particulate fill. Stuffing the containment bag into the cavity affords an additional containment layer around the particulate fill.

DESCRIPTION OF THE PREFERRED EMBODIMENTS

The present invention has utility as a plush. As used herein, a plush is defined to include a particulate filled fabric skin in the form of a doll, a pillow, a mat, a ball, and a tube. It is appreciated that an inventive plush is formed in a variety of dimensions and serves not only as an amusement, but also as a sleeping mat, a bag chair, and other pieces of plush furniture.

Figure 1:
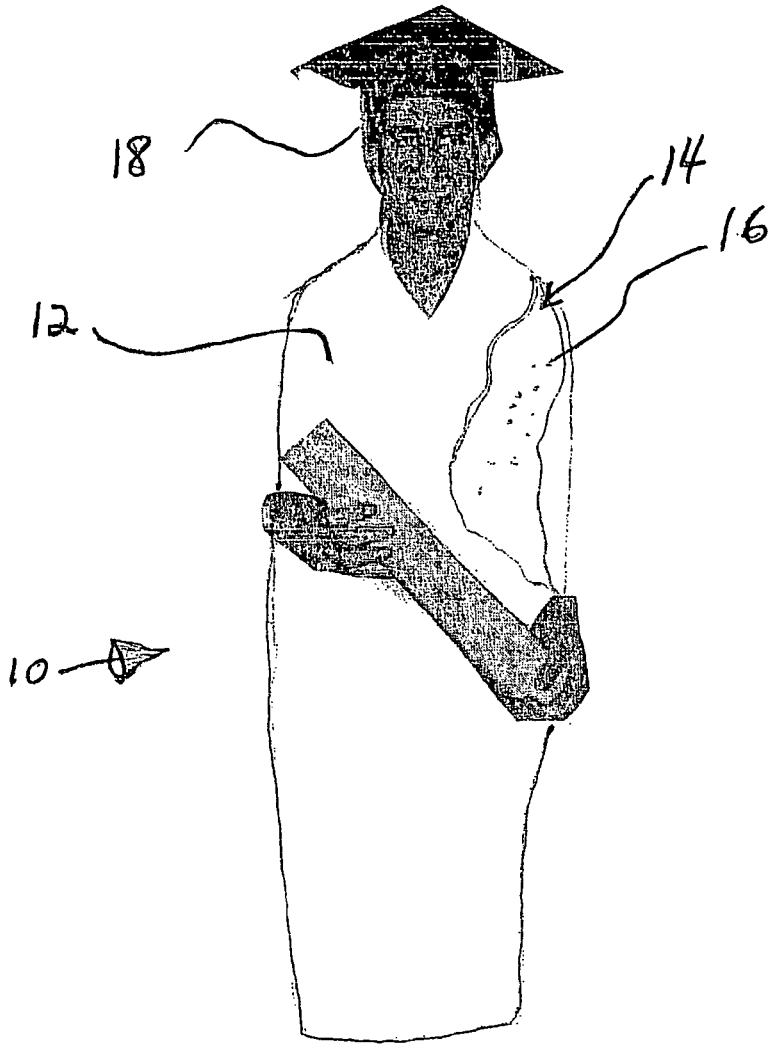
FIG. 1 is a partial cutaway frontal view of a doll form embodiment of an inventive plush.

Referring now to FIG. 1, an inventive plush is shown generally at 10. The plush 10 includes a fabric skin having a linear elastic elongation of at least 50% in a first direction. Linear elastic elongation is defined herein as the percentage a relaxed fabric stretches in the first direction and is capable of returning to the original relaxed state. Preferably, the fabric skin has a linear elastic elongation in the plane of the fabric skin 12 and at right angles to the first direction of at least 50%. More preferably, the fabric skin has a linear elastic elongation in the first direction of greater than 100%. Most preferably, the fabric skin 12 has a linear elastic elongation in the first direction of greater than 200%. A fabric skin according to the present invention is formed of materials illustratively including a stretch polyester, SPANDEX®, stretch nylon, and combinations thereof. While rubber sheeting is appreciated to satisfy the linear elongation requirements of an inventive fabric sheet, rubber sheeting is excluded as a fabric skin in an inventive plush as sheet materials lack the breathable aspect of a fabric. The fabric skin 12 is formed into a preselected plush shape to define a cavity 14. The skin 12 is readily sewn, fused, or glued along a seam between two overlapping layers of skin material to form such a cavity 14. The cavity 14 is then loaded with a particulate fill and the cavity sealed by techniques such as sewing, thermal fusion, and adhesive substances.

The fill 16 is composed as a particulate having a major axis and a minor axis, with the average particle size measured along the major axis between 0.25 millimeters (mm) and 10 mm. Typical aspect ratios between the major axis and minor axis of the particulate fill range from 10:1-1:1. Preferably, the aspect ratio of the particulate on the average is between 5:1 and 1:1.

Preferably, the average particle size is between 0.05 and 0.7 mm. More preferably, the average particle size is between 0.1 and 0.5 mm in size. Particulate fill 16 is readily formed from materials illustratively including sterilized natural products such as corn cob, grain husk, and cork; synthetic polymer such as acrylics, acrylates, polystyrene, polyvinylchloride, polyurethane, polyethylene, expanded forms of the aforementioned synthetic polymers, and hollow particle forms of the aforementioned synthetic polymers, as well as combinations thereof. Preferably, the particulate fill 16 is expanded polystyrene.

A graphic image 18 representative of a person, animal, or object is applied to the fabric skin 12 as to retain a linear elastic elongation of at least 50% in the first direction. The graphic image 18 is applied to the fabric skin 12 in such a way as to not make the fabric rigid through an over layer of ink, including dye sublimation printing, dot matrix printing, and magnetic bubble printing. The graphic image 18 is applied by dye sublimation printing. More preferably, the graphic image

18 is a photographic image of a person, animal, or object. More preferably, the graphic image 18 is a color image, as compared to grayscale.

Figure 2:
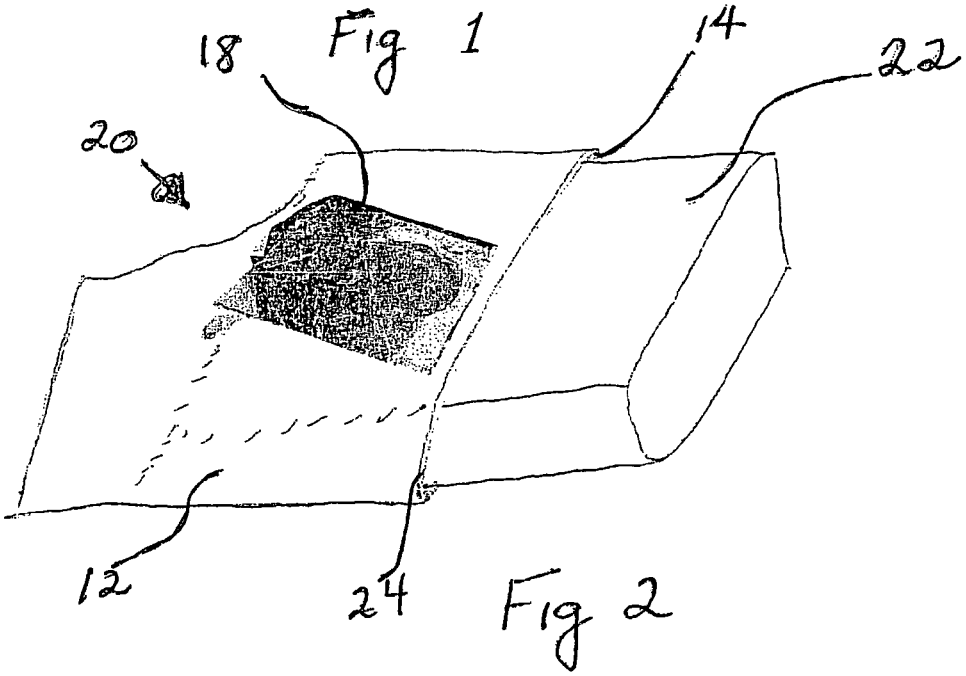
FIG. 2 is a partially disassembled perspective view of a pillow form embodiment having a self-containment bag within the inventive plush.

An alternate inventive embodiment is depicted in FIG. 2, with the plush assuming the form of a pillow, where like numerals correspond to those described above with respect to FIG. 1. FIG. 2 depicts, in general, a plush 20 characterized by a fill containment bag 22 containing fill therein (not shown). The fill containment bag 22 is sized to fill the cavity 14 within the form skin 12. The fill containment bag 22 is readily formed from a conventional fabric or sheeting material, but preferably is formed of a fabric satisfying the requirements of the skin 12.

A plush 20 is well suited for the production of an inventive, custom plush. A pre-sewn skin 12 having an opening 24 sufficiently large to allow the insertion of the bag 22 into the cavity 14 is provided. A custom graphic image is collected with a digital camera or other suitable image collection equipment. The image 18 is transferred to the skin 12 while the skin 12 is in an unfilled state. Suitable image transfer methodologies are detailed above. Thereafter, the skin 12 is filled by the placement of the bag 22 therein and the opening 24 is sealed to create the inventive plush 20.

An inventive plush as described herein and including inventive embodiments 10 or 20, is optionally impregnated with a volatile organic compound that functions as an aroma therapeutic. Such an aroma therapeutic is mixed with the plush fill or spotted onto the skin of the plush from which it is wicked into the plush cavity for subsequent sustained release.

One of skill in the art upon understanding of the above description will recognize various modifications to the invention that nonetheless remain within the spirit thereof. These modifications and all equivalents thereof are intended to be encompassed within the scope of the appended claims.

The invention claimed is:

1. A sensory stimulation plush comprising:

a fabric skin having a linear elastic elongation of at least 50% in the first direction, said skin formed into a plush shape so as to define a cavity;

a particulate fill within said cavity wherein a particle of said fill has a major axis and a minor axis, and said fill has an average particle size on the major axis of between 0.25 and 10 millimeters; and a photographic image emulative of a person, animal, or object imprinted on said skin so as to maintain the elastic elongation of said skin.

2. The plush of claim 1 wherein the plush shape is a doll.

3. The plush of claim 1 wherein the plush is a pillow.

4. The plush of claim 1 wherein said skin has a linear elongation at a right angle to the first direction of at least 50%.

5. The plush of claim 1 wherein the linear elongation in the first direction is at least 100%.

6. The plush of claim 1 wherein the linear elongation in the first direction is at least 200%.

7. The plush of claim 1 wherein the aspect ration of the major axis of said particulate of said fill is between 5:1 and 1:1.

8. The plush of claim 1 wherein the aspect ratio of the major axis to the minor axis of said particulate of said fill is between 2:1 and 1:1.

9. The plush of claim 1 wherein said particle size is between 0.05 and 0.7 millimeters.

10. The plush of claim 1 wherein said particulate fill is expanded polystyrene.

11. The plush of claim 1 wherein said graphic image is a photograph.

12. The plush of claim 1 further comprising a fill containment bag intermediate between said fabric skin and said particulate fill.

13. The plush of claim 1 further comprising a scent.

14. The plush of claim 13 wherein said scent is an aromatherapy compound.

15. The process for forming a plush comprising:

transferring a photographic image emulative of a person, animal, or object onto a fabric skin having a linear elastic elongation of at least 50% in the first direction by dye sublimation;

forming said fabric skin to define a cavity;

filling the cavity with a particulate fill; and sealing said particulate fill within the cavity.

16. The process of claim 15 further comprising loading a containment bag with said particulate fill and stuffing said bag into the cavity.

17. The process of claim 15 further comprising scenting said particulate fill.

* * * * *